United States Patent [19]

Peter

[11] Patent Number: 4,612,528

[45] Date of Patent: Sep. 16, 1986

[54] SINGLE OR MULTIPLE POLE OVERLOAD PROTECTIVE CIRCUIT BREAKER HAVING AN INTEGRATED SIGNAL CONTACT POINT

[75] Inventor: Josef Peter, Altdorf, Fed. Rep. of Germany

[73] Assignee: Ellenberger & Poensgen, Altdorf, Fed. Rep. of Germany

[21] Appl. No.: 753,630

[22] Filed: Jul. 10, 1985

[30] Foreign Application Priority Data

Aug. 3, 1984 [DE] Fed. Rep. of Germany ..... 3428637

[51] Int. Cl.[4] ..... H01H 71/04; H01H 73/12

[52] U.S. Cl. ..... 337/79; 335/13; 337/66

[58] Field of Search ..... 337/79, 66, 379; 335/13, 17

[56] References Cited

U.S. PATENT DOCUMENTS

| | | | |
|---|---|---|---|
| 3,593,235 | 7/1971 | Nicol | 335/13 |
| 3,706,057 | 12/1972 | Ellenberger | 337/66 |
| 4,330,772 | 5/1982 | Hastings et al. | 337/66 |

*Primary Examiner*—Harold Broome
*Attorney, Agent, or Firm*—Spencer & Frank

[57] ABSTRACT

A single pole or multi-pole, manually or thermally operable overload protective circuit breaker contains in its main switching chamber an elbow lever which consists of an actuating arm and a main contact arm, and functions as active connection between an actuating element and a contact bridge member. The ends of the actuating arm and the main contact arm, which face away from the elbow joint, are articulatedly connected with a pressure button or the like actuating element and the contact bridge member, respectively. In any positions of swivelling from a folded, i.e. the circuit-breaking, to a stretched, i.e., an arrested circuit making position, of the elbow lever, the centers of the swivel joints are located on the central longitudinal axis of the circuit breaker, which axis extends toward the depth of an insulating housing of the latter. In the stretched position of the elbow lever, its actuating arm exerts pressure by means of a tripping projection, provided on the arm end near the swivel joint therefor, on a double-arm signal contact lever. This lever has a trip lever arm projecting into the main switch chamber, and another arm being lodged in an attachment casing mounted on the insulating housing and containing a signal contact point. This other arm can act upon a signal contact spring and can thereby make or break contact at the auxiliary or signal contact point provided by the contact spring and a fixed contact.

22 Claims, 4 Drawing Figures

SINGLE OR MULTIPLE POLE OVERLOAD PROTECTIVE CIRCUIT BREAKER HAVING AN INTEGRATED SIGNAL CONTACT POINT

BACKGROUND OF THE INVENTION

This invention relates to a manually or thermally operable overload protective circuit breaker comprising at least one pole,

- a housing of electrically insulating material, having a central longitudinal axis and having in the housing a main switch chamber,
- an actuating element, preferably a pressure button or push-button, accessible from outside the housing and being arranged displaceably along the said central longitudinal axis,
- at least two contact posts associated with, and preferably inside the housing,
- an elbow lever lodged in the main switch chamber and comprising an actuating arm, a main contact arm and an elbow joint, each of the two arms having a first end at which the arms are articulatedly connected with each other by means of the said elbow joint, and a second arm end remote from the elbow joint;
- contact-making bridge means being responsively connected with the actuating element by means of the elbow lever, for making or breaking circuit between the two contact posts,
- restoring means, preferably a restoring spring, for permanently biassing the elbow lever toward a contact-breaking position;
- a first swivel joint articulatedly connecting the second arm end of the actuating arm of the elbow lever with the said actuating element, e.g. with the pressure button,
- a second swivel joint articulatedly connecting the second end of the main contact arm of the elbow joint with the contact making bridge means.

An overload protective circuit breaker of this type has been described in German Pat. No. 2,123,765. In this known construction, the elbow lever is movable between a substantially stretched, arrested limit position making circuit, and a maximally folded limit position breaking circuit. The centers of the swivel joints are located, in any position from the stretched to the maximally folded limit position of the elbow lever, on the central longitudinal axis which extends in the direction of the depth of the housing, i.e. toward the end thereof remote from the said actuating element.

In this known circuit breaker, the force of a spring adapted to act upon the elbow lever urges the actuating arm of the elbow lever away from its main contact arm. When the circuit-making position is attained, the elbow lever is arrested by a catch which can be released by hand, or by thermal action. The construction of this known circuit breaker, which has been described more in detail in the above-mentioned German Pat. No. 2,123,765, permits obtainment of an instant making of the circuit by simple, space-saving means, and, moreover, a manual release, an extremely rapid thermal release and a trip-free release and breaking of the circuit.

A simlar construction of an elbow lever and associated auxiliary levers has been described in German patent No. 2,507,454. In this case, the single pole overload protective circuit breaker constitutes a multi-pole switch and comprises auxiliary levers being connected via a common shaft, an arrangement which permits obtainment of an essentially simultaneous release of all poles without requiring any greater mechanical forces influencing the switching time than would be required in the case of a single pole release.

A drawback of conventional overload protective circuit breakers, regardless whether they have a single pole or plurality of poles, resides in the lack of a signal contact point which will, by means of a signal circuit connected therewith, yield information about the momentary state of the circuit breaker. For example, a switch box having a number of protective circuit breakers in the power supply, e.g., of an electric air-craft wiring, can be compared herewith, in which the lack of signal lamps indicating the release of a circuit breaker would make it most difficult to locate a point of failure quickly and accurately.

An overload circuit breaker having a signal contact point has been described in Swiss Pat. No. 233,959 in which a contact bridge displaces, during its closing movement, a dividing wall of insulating material which projects into the path of shifting movement of the contact bridge, such displacement occurring in contact-making direction. The free end of this dividing wall, on the side of the signal contact, controls a movable auxiliary contact member of the signal contact point. A drawback of this construction resides in the fact that the restoring force of an auxiliary contact spring acts directly counter to the closing direction of the contact bridge. This reduces the attainable contact pressure and, together therewith, the current-carrying capacity of the main contact. Moreover, the restoring force increases friction between the individual parts at the latching-in point of the elbow lever whereby the required releasing force is increased in turn. This prolongs the release time of conventional overload circuit breakers of this kind, and naturally reduces their protective effectiveness.

OBJECTS AND SUMMARY OF THE INVENTION

It is a principle object of the invention to solve the task of devising an overload protective circuit breaker of the initially described type in such a manner that it provides a signal contact point which is adapted for making circuit unequivocally coupled with the circuit-making or circuit-breaking position, respectively, of the overload circuit breaker without, however, causing a deterioration of its contact pressure and release characteristics.

This task is accomplished, and the above-mentioned objects are attained, in accordance with the invention, by providing in the initially described overload protective circuit breaker

- an attachment casing mounted on the housing thereof,
- a signal contact lever comprising a fulcrum, a trip lever arm projecting from the fulcrum into the main switch chamber, and a signal contact arm extending into the said casing,
- a fixed contact and a signal contact spring which are both lodged in the casing and form a signal contact point therebetween, while
- the actuating arm of the elbow lever comprises tripping means, for instance of disk shape, which projects from the arm in the region of its first arm end, and which are adapted for engaging the signal contact lever when the elbow lever is in stretched position, and the signal contact arm is adapted for carrying out a swivel movement dependent on the position of the tripping means, and thereby acts upon the signal contact spring so as to make or break circuit with the fixed contact at the signal contact point.

Thereby, the actuating arm of the elbow lever will, with increasing stretching of the latter by means of a tripping projection mounted on the said first end of the actuating arm which is adjacent the elbow joint, increasingly deflect the said double-armed signal contact lever. The release characteristic of the overload circuit breaker remains essentially unchanged in the above-described construction according to the invention, as there prevail, in this structure, leverages which are completely different from those prevailing in conventional overload circuit breakers. These novel kinds of leverages permit maintaining the usual contact pressure and, advantageously, will not increase the release time although the elbow lever has to carry out the additional function of operating a signal contact point. The open or closed state of the latter is dependent on the instant swivel position of the signal contact lever, which position is in turn determined by the position of the tripping projection of the actuating arm in the main switch chamber. When the overload protective circuit breaker is, for instance, brought to its circuit-making position by stretching of the elbow lever, then, the tripping projection acting on the signal contact lever will be moved outwardly, and the resulting swivel movement of the latter lever will gradually push the signal contact spring away from the fixed contact at the signal contact point and, for instance, thereby interrupt the circuit of a small signal lamp. This will indicate an unequivocal coordination of the states: Circuit breaker "ON"-Signal contact "OUT", or viceversa. In the same simple manner, with a few structural changes of the signal contact lever, changes well known to the art-skilled in this field, and similarly at the signal contact point, there can be provided an unequivocal indication of the states: Circuit breaker "ON"-Signal contact "ON", and viceversa.

Preferably, the movements of the elbow lever and of the signal contact lever take place in the same plane; this enables a particularly simple mechanical construction of the overload protective circuit breaker according to the invention as there is no need for any complicated mechanical structural elements for transmitting a mechanical movement from one plane to another.

A particularly simple construction of the attachment casing containing the signal contact point is provided by making the attachment casing integral with the housing containing the main switch chamber, thereby rendering the manufacture particularly efficient and economical, and enabling a rapid assembly of the circuit breaker according to the invention.

In a preferred embodiment thereof, the fulcrum of the signal contact lever is mounted in a region in which the casing is merged with the housing; thereby, the arms of the signal contact lever can be made of approximately equal length, so that the resulting lever forces and paths are kept to a minimum.

In a particularly preferred embodiment of the circuit breaker according to the invention, the said casing has a casing wall remote from the main switch chamber, and the fixed contact is straight and extends in the casing substantially parallel with the central longitudinal axis of the housing; moreover, the signal contact spring is U-shaped having two U-legs and an intermediate U-portion therebetween; and this spring is located in a region of the casing vicinal to the main switch chamber and constitutes a movable contact member therein, while the U-legs of the signal contact spring extend substantially parallel with the fixed contact.

This embodiment offers particular advantages as, for instance, the signal contact at the said point is safely made with the aid of the high spring force of the U-legs of the contact spring, when the L-shaped lever is not influenced in the circuit-making position of overload circuit breaker. The specific shapes and orientation of its elements as described hereinbefore impart to the entrie unit of the attachment casing a high degree of compactness which enables an assembly thereof free from the problems that tend to occur in switch cases of conventional construction. This advantage is further enhanced, when the central longitudinal housing axis extends in a direction from the actuating element through the switch chamber to a region of the latter containing the contact posts, in the depth of the housing, and the intermediate U-portion of the signal contact spring is located in the casing on the same side, in axial direction, as the last-mentioned depth of the chamber, while a first one of the U-legs is arranged to extend adjacent the fixed contact, and preferably substantially parallel therewith, and is adapted to form the signal contact point with it.

Moreover, the signal contact arm, which is preferably L-shaped, has its substantially horizontal leg flanking the intermediate U-portion of the signal contact spring, and a substantially vertical leg of the L-shaped signal contact arm is adapted for engaging the said first U-leg of the signal contact spring which leg is adjacent to the fixed contact, in such a manner as to deflect this spring leg away from the fixed contact, thereby breaking circuit at that point. The substantially vertical leg of the L-shaped signal contact arm can be so disposed in the casing as to engage the first U-leg of the contact spring on the side thereof facing toward the fixed contact, i.e., away from the main switch chamber, and to urge that first U-leg in a direction toward the said chamber.

Further advantages can be added to those of the lastdescribed preferred embodiment, by providing the following additional features in the attachment casing:

two metal sleeves having each a longitudinal sleeve axis, which axes enclose an acute angle whose apex points in a direction parallel with the central longitudinal housing axis and away from the contact posts in the housing;

a first one of these sleeves being electrically conductively connected with the signal contact spring, and the other sleeve being connected in a like manner with the fixed contact. Preferably, the longitudinal sleeve axes define a plane which extends perpendicularly relative to the plane in which the signal contact lever can be swiveled. It is thereby possible possible to arrange the main circuit lines as well as the signal contact lines at the rear of the casing from the same side thereof, while the rearwardly opening, angular arrangement of the metal sleeves permits the electrical supply lines for the signal casing to be arranged without problems on both sides of the main lines and to be connected with their respective metal sleeves.

Further preferred embodiments of the circuit breaker according to the invention contain one or several of the following features:

The tripping means projecting outwardly from the actuating arm of the elbow lever extend in the same direction in which the elbow joint moves during folding together the arms of that lever.

The contact posts are preferably located in the depth of the housing and the trip lever arm bears an abutment face, adapted for being engaged by the said tripping means, which is inclined in a direction toward the region of the housing containing the contact posts.

This abutment face of the trip lever arm of the signal contact lever can also extend in a plane intersecting the central longitudinal axis of the housing at an angle of 45° whose apex is located on the aforesaid axis and points toward the contact posts.

Thereby, the mechanical forces required for operating the additional signal contact lever are kept at a minimum.

In combination with the advantage-enhancing features described further above,—among them a U-shaped signal contact spring and a signal contact lever having an L-shaped contact arm—the restoring swivel movement of the signal contact lever, caused by the spring force of the U-shaped signal contact spring, even supports the stetching movement of the elbow lever in the main switch chamber. For the trip lever arm of the signal contact lever, when engaging the cam portion of the tripping projection on the actuating arm of the elbow lever, will urge the latter into stretched condition and afford, together with that cam, a low-friction sliding movement of the latter during the circuit-making phase of the operation.

The release characteristic curve of the overload circuit breaker according to the invention is further improved by providing that, when the elbow lever is in stretched condition, the cam portion of the tripping means abuts against the abutment face of the trip lever arm of the signal contact lever in a manner such that the said lever is moved against the restoring bias of the signal contact spring, and that the vector along which reaction pressure is exerted by the trip lever arm on the tripping means cam portion, will extend through the center of the above-mentioned first swivel joint. As a consequence of the aforesaid reaction pressure vector extending through the first swivel joint center of the elbow lever actuating arm, on the side of the latter being actuated upon by the pressure button or the like actuating element, no additional moments of rotation will act on the elbow lever arrangement when in circuit-making position.

BRIEF DESCRIPTION OF THE DRAWINGS

Further objects and advantages of the invention will become apparent from the following more detailed description thereof in connection with the accompanying drawings in which.

DETAILED DESCRIPTION OF THE EMBODIMENT SHOWN IN THE DRAWING

Figure 1:
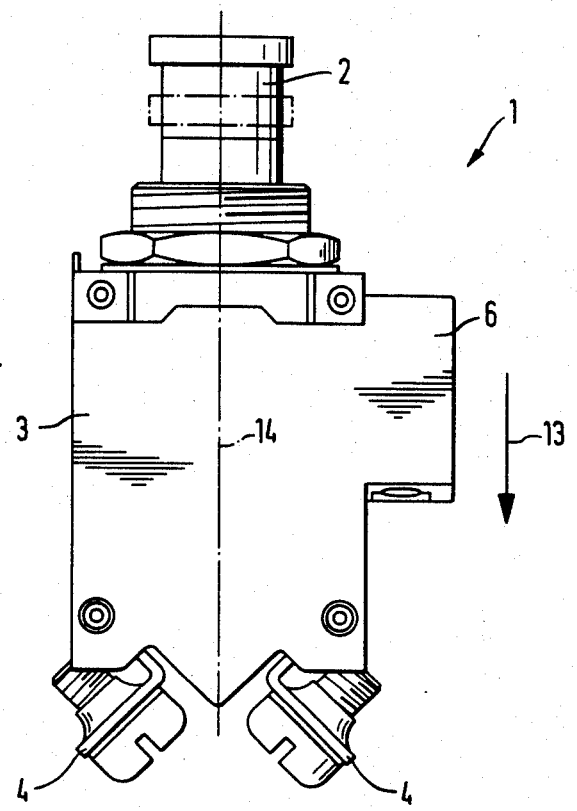
FIG. 1 shows a lateral view of a preferred embodiment of the overload protective circuit breaker according to the invention.

As shown in FIG. 1, the overload protective circuit breaker 1 comprises as the actuating member 2 a pressure button by making or breaking contact in the circuit breaker by hand. From its insulating housing 3, two main contact vanes 4 protrude downwardly and bear the main contact posts or beads 5. A signal contact point 7 (visible in FIGS. 2 and 3) is located in an attachment casing 6 which is molded integrally with the circuit breaker housing 3.

Figure 2:
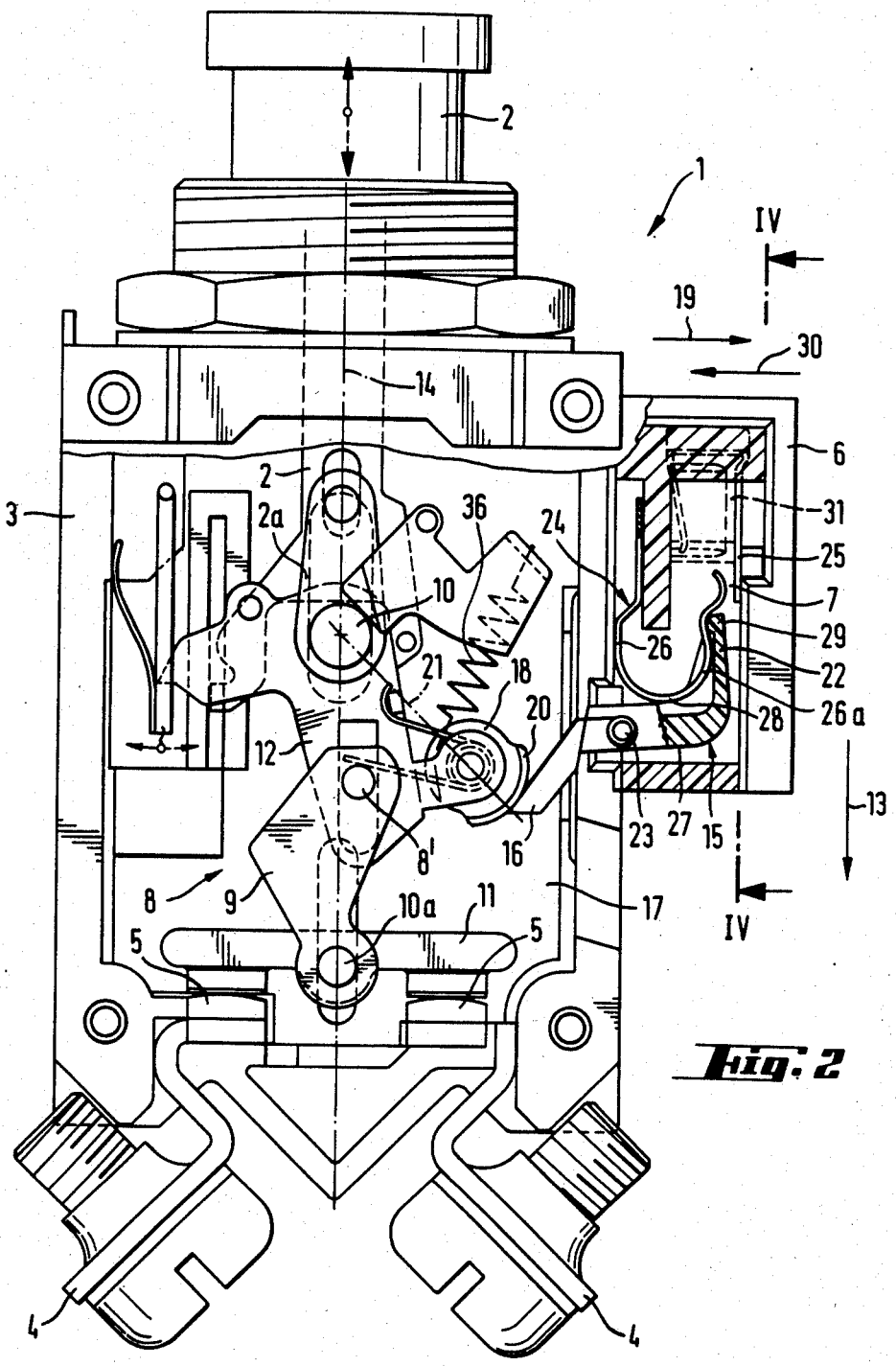
FIG. 2 shows a similar, but partially sectional view of the embodiment shown in FIG. 1, on an enlarged scale, with the movable parts in circuit-making or "ON"-position.

In FIG. 2 there is also shown the elbow lever 8. The main contact arm 9 of this lever 8 is connected at its lower end with a contact bridge piece 11 via a swivel joint 10*a* and, in the circuit-making "ON"-position shown in FIG. 2, this bridge piece 11 connects the two contact posts 5 conductively with each other. The elbow joint 8' comprises a pin-and-slot arrangement by means of which the main contact arm 9 is connected with an actuating arm 12 which is in turn connected via another swivel joint 10 and a coupling element 2*a* with the actuating member, i.e. the pressure button 2. In any random position which the elbow lever 8 may adopt between the "ON"-position shown in FIG. 2 and the "OFF"-position shown in FIG. 3, the connecting line between the central axes of the two swivel joints 10 and 10*a* always coincides with the central longitudinal axis 14 of the insulating housing 3, which axis extends in the direction of the depth of the housing as indicated by an arrow 13.

For, in this "ON"-position, the tripping disc 18 projects outwardly from the actuating arm 12 in the direction indicated by an arrow 19 in which the arms 9 and 12 of the elbow lever 8 will be folded together when moving toward the "OFF"-position. This arrangement, in cooperation with the trip lever arm 16 of the signal contact lever 15, which arm 16 extends obliquely downwardly in a direction toward the main contact posts 5, guarantees that only small friction forces will have to be overcome when the circuit breaker is "switched on" to make contact. When the elbow lever 8 is in stretched condition as shown in FIG. 2, the tripping disk 18 moves the signal contact lever 15 in such a manner that the line of force action (vector line) 21 of the reactive pressure exerted by the tripping disk 18 on the trip lever arm 16 extends through the swivel joint 10 which is located in the actuating arm 12 on the side thereof facing toward the actuating element (pressure button) 2. Thereby, the release characteristic property of the circuit breaker according to the invention will not be influenced in a negative manner, i.e., the fundamental construction of the overload circuit breaker according to the invention, having an integrated signal contact attachment, may correspond to that of a conventional overload protective circuit breaker. An L-shaped contact arm 22 of the signal contact lever 15 which is supported for swivelling about its fulcrum 23, extends, in the interior of the attachment casing 6, to behind a U-shaped contact spring 24. The latter, together with a fixed contact 25, define between them the signal contact point 7 which is opened or closed depending on the swivel position of the signal contact lever 15.

Figure 3:
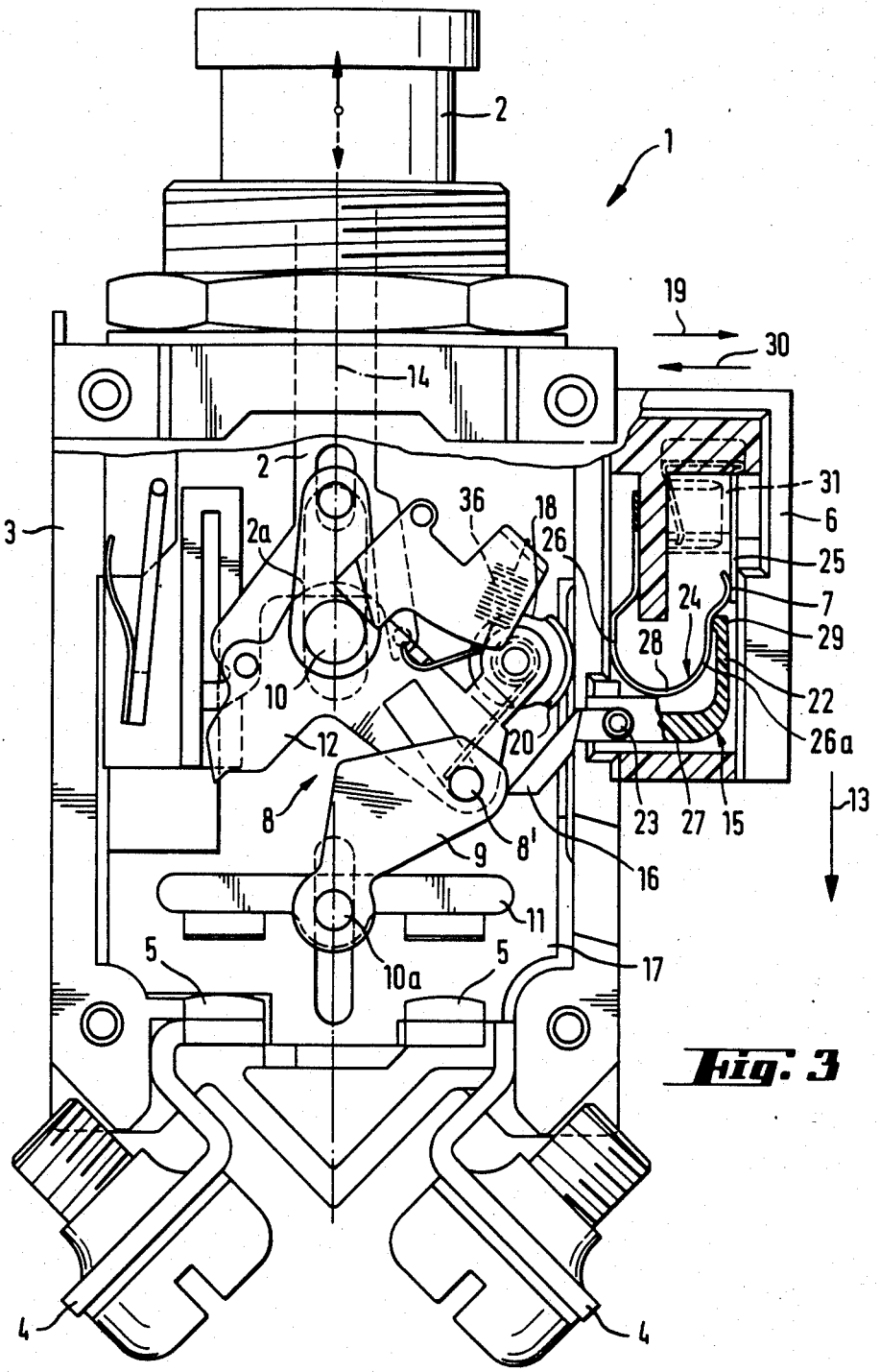
FIG. 3 shows a similar partially sectional view as in FIG. 2, but with the movable parts in circuit-breaking or "OFF"-position.

As can be seen from FIGS. 2 and 3, the U-shaped contact spring 24 has two U-legs 26 and 26*a* extending substantially parallel with the fixed contact 25 and with the direction of the arrow 13 pointing into the depth of the housing 3, which U-legs are interconnected by an intermediate U-portion 28. The L-shaped contact arm 22 comprises a horizontal leg 27 toward which there is facing the intermediate U-portion 28, and a vertical leg 29 which is adapted for deformingly engaging the U-leg 26*a*, adjacent the fixed contact 25, of the U-shaped conspring 24 which thus acts as a movable contactor member. Pressure exerted by the inwardly swiveling vertical leg 29 against the leg 26*a* of the U-shaped spring 24 will thus deflect the latter in the direction toward the main switch chamber 17, as indicated by an arrow 30.

Figure 4:
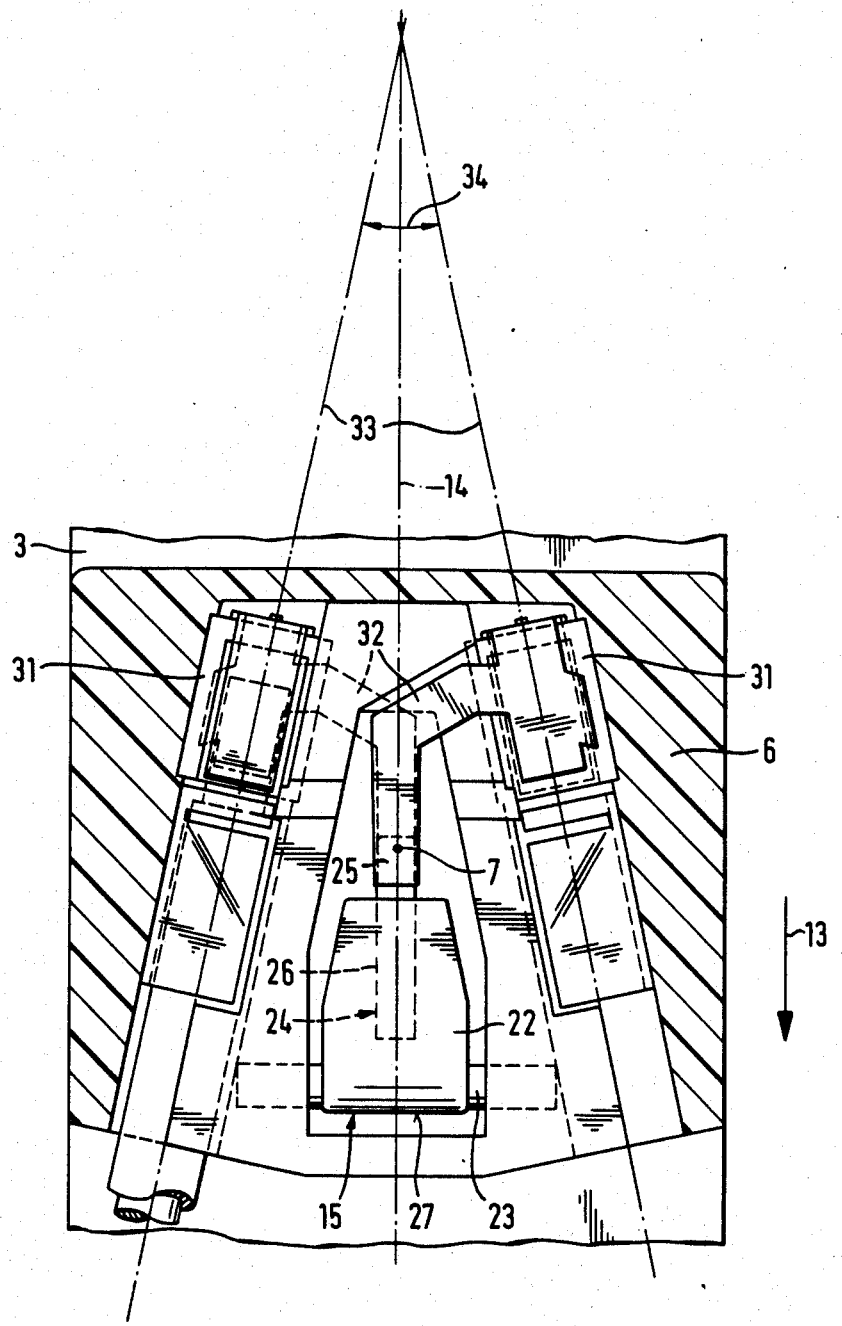
FIG. 4 is a partially sectional view on to the attachment housing taken along a plane indicated by IV—IV in FIG. 2.

FIG. 4 illustrates the manner in which the contact spring 24 and the fixed contact 25, forming between them the signal contact point 7, are connected electrically with the metal sockets 31. The electrical connection with the structural elements 24, 25 and 31 is guaranteed by the contact spring 24 and electrically conducting connecting pieces 32 which are molded integrally with the fixed contact 25. The metal sockets 31 are arranged in the attachment casing 6 on both sides of the signal contact point 7, and their axes 33 enclose an acute angle 34 which opens toward the depth of the housing 3, i.e., its apex is located in the opposite direction of arrow 13, and the plane defined by the legs of this angle 34 extends perpendicularly with regard to the plane in which the signal contact lever 15 is movable. Thus, no problem arises when attaching the necessary four connecting leads to the main contact posts 5 and to the terminals of signal contact point 7 in the overload protective circuit breaker according to the invention.

A tension spring 36 urges the elbow lever 8 into folded, contact-breaking position.

I claim:

1. A manually or thermally operable overload protective circuit breaker comprising at least one pole, a housing of electrically insulating material, having a central longitudinal axis, a main switch chamber in said housing, an actuating element accessible from the outside of said housing and being arranged displaceably along said central longitudinal axis, at least two contact posts associated with said housing, an elbow lever lodged in said main switch chamber and comprising an actuating arm, a main contact arm and an elbow joint, each of said two arms having a first arm end at which the arms are articulatedly connected with each other by said elbow joint, and a second arm end remote from said elbow joint, contact-making bridge means being responsively connected with said actuating element by means of said elbow lever for making or breaking contact between said two contact posts, restoring means for permanently biassing said elbow lever toward a contact-breaking position, a first swivel joint articulatedly connecting said second end of said actuating arm with said actuating element, a second swivel joint articulatedly connecting said second end of said main contact arm with said contact-making bridge means, said elbow lever being movable between a stretched position making circuit and a folded position breaking circuit, said first and second swivel joints being both located, in both said stretched and folded positions as well as in any transitional position therebetween, on said central longitudinal axis, or substantially thereon, an attachment casing mounted on said housing, a signal contact lever comprising a fulcrum, a trip lever arm projecting from said fulcrum into said main switch chamber, and a signal contact arm extending into said casing, a fixed contact and a signal contact spring being both lodged in said housing and forming a signal contact point therebetween;

said actuating arm of said elbow lever comprising tripping means projecting therefrom in the region of said first arm end thereof and being adapted for engaging said signal contact lever when said elbow lever is in stretched position, and said signal contact arm is adapted for carrying out a swivel movement dependent on the position of said tripping means, and thereby acting upon said signal contact spring so as to make or break circuit with said fixed contact at said signal contact point.

2. The circuit breaker of claim 1, wherein the movements of said elbow lever and of said signal contact lever take place in the same plane.

3. The circuit breaker of claim 1, wherein said attachment casing is integral with said housing containing said chamber.

4. The circuit breaker of claim 1, wherein said fulcrum of said signal contact lever is mounted in a region of said casing where the same merges with said housing.

5. The circuit breaker of claim 1, wherein said casing has a casing wall remote from said main switch chamber, said fixed contact is straight and extends in said casing substantially parallel with said central longitudinal axis, and said signal contact spring is U-shaped having two U-legs and an intermediate U-portion therebetween, said signal contact spring being located in a region of said casing vicinal to said main switch chamber and constituting a movable contact means therein, said U-legs extending substantially parallel with said fixed contact.

6. The circuit breaker of claim 5, wherein said central longitudinal axis extends in a direction from said actuating element through said chamber to a region thereof containing said contact posts, and said intermediate U-portion of said U-shaped signal contact spring is located in said casing on the same side, in axial direction, as said last-mentioned chamber region, a first one of said U-legs being adjacent said fixed contact and adapted for forming said signal contact point therewith.

7. The circuit breaker of claim 6, wherein said signal arm is L-shaped and has a substantially horizontal leg flanking said intermediate U-portion of said signal contact spring, and a substantially vertical leg being adapted for engaging said first U-leg of said signal contact spring, being adjacent said fixed contact, in such a manner as to deflect said first U-leg away from said fixed contact, thereby breaking circuit at said signal contact point.

8. The circuit breaker of claim 7, wherein said substantially vertical leg of said L-shaped signal contact arm is so disposed in said casing as to engage said first U-leg on the side thereof facing away from said main switch chamber and deflecting said first U-leg in a direction toward said chamber.

9. The circuit breaker of claim 1, wherein said casing comprises two metal sleeves having each a longitudinal sleeve axis, said sleeve axes enclosing an acute angle whose apex points in a direction parallel with said central longitudinal axis and away from said contact posts, said signal contact spring being electrically conductively connected with a first one of said sleeves, and said fixed contact being electrically conductively connected with the other sleeve.

10. The circuit breaker of claim 9, wherein said longitudinal sleeve axes define a plane extending perpendicularly relative to the plane in which said signal contact lever can be moved.

11. The circuit breaker of claim 1, wherein said tripping means project outwardly from said actuating arm of said elbow lever in the same direction in which said elbow joint moves during folding of said elbow lever.

12. The circuit breaker of claim 11, wherein said tripping means comprise convex cam means in a zone thereof adapted for engaging said signal contact lever.

13. The circuit breaker of claim 1, wherein said contact posts are located in said housing and said trip lever arm bears an abutment face adapted for being engaged by said tripping means, said abutment face being inclined in a direction toward the region of said contact posts.

14. The circuit breaker of claim 13, wherein said abutment face extends in a plane intersecting said central longitudinal axis under an angle 45° whose apex is located on said last-mentioned axis and points toward said contact posts.

15. The circuit breaker of claim 1, wherein said attachment casing comprises two metal sleeves having each a longitudinal axis, the two sleeve axes enclosing an acute angle whose apex points in a direction parallel with that of said central longitudinal axis and away from said contact posts, said signal contact spring being electrically conductively connected with a first one of said sleeves, and said fixed contact being electrically conductively connected with the other sleeve, and said tripping means projecting outwardly from said actuating arm of said elbow lever in the same direction in which said elbow joint moves during folding of said elbow lever.

16. The circuit breaker of claim 15, wherein said contact posts are located in said housing, and said trip lever arm bears an abutment face adapted for being engaged by said tripping means, said abutment face being inclined in a direction toward the region of said contact posts in said housing.

17. The circuit breaker of claim 13, wherein, when said elbow lever is in stretched position, said tripping means abut against said abutment face of said trip lever arm in a manner such that said signal contact lever is moved against the restoring bias of said signal contact spring, and that the vector of the reaction pressure exerted by said trip lever arm on said tripping means extends through the center of said first swivel joint.

18. The circuit breaker of claim 15, wherein, when said elbow lever is in stretched position, said tripping means engages said trip lever arm in a manner such that said signal contact lever is moved against the restoring bias of said signal contact spring, and that the line of force action of the reaction pressure exerted by said trip lever arm on said tripping means extends through the center of said first swivel joint.

19. The circuit breaker of claim 15, wherein said tripping means project outwardly from said actuating arm of said elbow lever in the same direction in which said elbow joint moves during folding of said elbow lever.

20. The circuit breaker of claim 19, wherein said tripping means comprise convex cam means in the zone thereof adapted for engaging said signal contact lever.

21. The circuit breaker of claim 16, wherein said abutment face extends in a plane intersecting said central longitudinal axis under an angle of 45° whose apex is located on said central longitudinal axis and points toward said contact posts.

22. The circuit breaker of claim 15, wherein said longitudinal sleeve axes define a plane extending perpendicularly relative to the plane in which said signal contact lever can be moved.

* * * * *